US007753549B2

(12) United States Patent
Solinsky et al.

(10) Patent No.: US 7,753,549 B2
(45) Date of Patent: Jul. 13, 2010

(54) WEAPON AIMING DEVICE

(75) Inventors: Kenneth S. Solinsky, Bedford, NH (US); Scott D. Moody, Manchester, NH (US); Andrew Russell, Amherst, NH (US)

(73) Assignee: L-3 Insight Technology Incorporated, Londonderry, NH (US)

( * ) Notice: Subject to any disclaimer, the term of this patent is extended or adjusted under 35 U.S.C. 154(b) by 16 days.

(21) Appl. No.: 11/670,006

(22) Filed: Feb. 1, 2007

(65) Prior Publication Data

US 2008/0000133 A1 Jan. 3, 2008

Related U.S. Application Data

(60) Provisional application No. 60/764,716, filed on Feb. 2, 2006.

(51) Int. Cl.
*F41G 1/35* (2006.01)

(52) U.S. Cl. ..... 362/110; 362/231; 362/259; 362/323; 362/324; 42/15

(58) Field of Classification Search ..... 42/114, 42/115, 117; 362/259, 268, 109–115, 187, 362/280, 282, 322–324, 230, 231
See application file for complete search history.

(56) References Cited

U.S. PATENT DOCUMENTS 4,947,291 A * 8/1990 McDermott ..... 362/19
5,355,609 A * 10/1994 Schenke ..... 42/115
5,584,569 A * 12/1996 Huang ..... 362/288
5,684,644 A * 11/1997 Spears et al. ..... 359/823
5,701,206 A * 12/1997 Sasaki et al. ..... 359/704
5,822,905 A * 10/1998 Teetzel ..... 42/117
6,190,022 B1 * 2/2001 Tocci et al. ..... 362/259
6,431,731 B1 * 8/2002 Krietzman ..... 362/259
7,378,626 B2 * 5/2008 Fetterly ..... 244/3.1
2002/0194767 A1 * 12/2002 Houde-Walter et al. ..... 42/114
2005/0115089 A1 * 6/2005 Johnson ..... 33/265
2006/0048432 A1 * 3/2006 Staley, III ..... 42/122
2008/0077198 A1 * 3/2008 Webb et al. ..... 607/88

OTHER PUBLICATIONS

Insight Technology Incorporated, AN/PEQ-15, Standard Power Advanced Target Pointer Illuminator Aiming Laser. Copyright 2005.

Insight Technology Incorporated, LA-5/PEQ, High Power Advanced Target Pointer Illuminator Aiming Laser. Copyright 2005.

Insight Technology Incorporated, AN/PEQ-2A, Infrared Target Pointer Illuminator/Aiming Light. Copyright 2005.

Insight Technology Incorporated, AN/PAQ-4C, Infrared Aiming Laser. Copyright 2005.

(Continued)

*Primary Examiner*—Thomas M Sember

(57) ABSTRACT

A weapon mountable aiming system has a multi-laser assembly having a first visible laser pointer assembly, a second infrared laser pointer assembly, and an infrared laser illuminator assembly whose generated light beams extend outwardly through an opening in an actuator used to adjust the divergence of the infrared laser illuminator assembly. The multi-laser assembly being steerable by a set of adjusters in the weapon mountable aiming system to allow alignment of the generated light beams with a point of impact of a bullet with a target.

11 Claims, 11 Drawing Sheets

OTHER PUBLICATIONS

Insight Technology Incorporated, AN/PEQ-4, Medium Power Laser Illuminator. Copyright 2005.

Insight Technology Incorporated, AN/PSQ-18A, M203 Day Night Sight. Copyright 2005.

Insight Technology Incorporated, AN/PEQ-14, Integrated Laser White Light Pointer. Copyright 2005.

Insight Technology Incorporated, AN/PEM-1, Laser Borelight System. Copyright 2005.

Insight Technology Incorporated, GLWD, Green Laser Warning Device. Copyright 2005.

Insight Technology Incorporated, ISM, Integrated Sighting Module. Copyright 2005.

Insight Technology Incorporated, M6X, Tactical Light with Visible Laser. Copyright 2005.

Insight Technology Incorporated, SU-233/PVS, M3X Tactical Illuminator. Copyright 2005.

Insight Technology Incorporated, AN/PAS-23, Mini Thermal Monocular (MTM). Copyright 2005.

Insight Technology Incorporated, SU-232/PAS, Clip-On Night Vision Device-Thermal. Copyright 2005.

Insight Technology Incorporated, AN/PSQ-23, Storm-MLRF. Copyright 2005.

Insight Technology Incorporated, Catalog, Copyright 2007.

* cited by examiner

WEAPON AIMING DEVICE

CROSS REFERENCE TO RELATED APPLICATIONS

The present application claims the benefit of U.S. provisional patent application Ser. No. 60/764,716, filed Feb. 2, 2006, the entire disclosure of which is incorporated herein by reference.

BACKGROUND OF THE INVENTION

In close quarter combat, typically in the range of 2-800 meters, soldiers are required to rapidly acquire, identify, and accurately fire on enemy targets. Soldiers may use weapon-mounted sights with visible and infrared light sources to assist in the aiming process during daytime and nighttime missions. These sights may be mounted on vehicle-mounted weapons and handheld weapons such as the M4A1 carbine and other small arms and are used to provide better target observation, illumination, and marking.

FIG. 1 is an isometric view of a weapon mountable sight 100 with optics and electronics at least partially enclosed in a housing 102. The sight 100 has a visible laser pointer assembly 110, an infrared laser pointer assembly 112, an infrared illuminator assembly 108, and a white light assembly 170, controlled by one or more switch actuators. The visible laser pointer assembly 110 and the infrared laser pointer assembly 112 are mounted on a common optical bench and can be bore sighted using up-down adjuster 130 and left-right adjuster 128, after being secured to a weapon (not shown). Infrared illuminator assembly 108 is mounted on a second, separate optical bench and can be bore sighted using up-down adjuster 130' and left-right adjuster (not shown). The size of the resulting infrared illuminator beam may be adjusted by rotation of a beam adjuster 132. Rotation of the beam adjuster causes a lens to translate generally parallel to a longitudinal axis of the barrel of the weapon relative to an infrared diode coupled to the second optical bench.

Aiming devices are often mounted on handheld weapons where weight and size are important design criteria. Limiting the number of optical benches and associated adjusters saves space, weight, and makes bore sighting simpler. Having a beam adjuster that can be manipulated by users wearing gloves is also desirable.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

Figure 1:
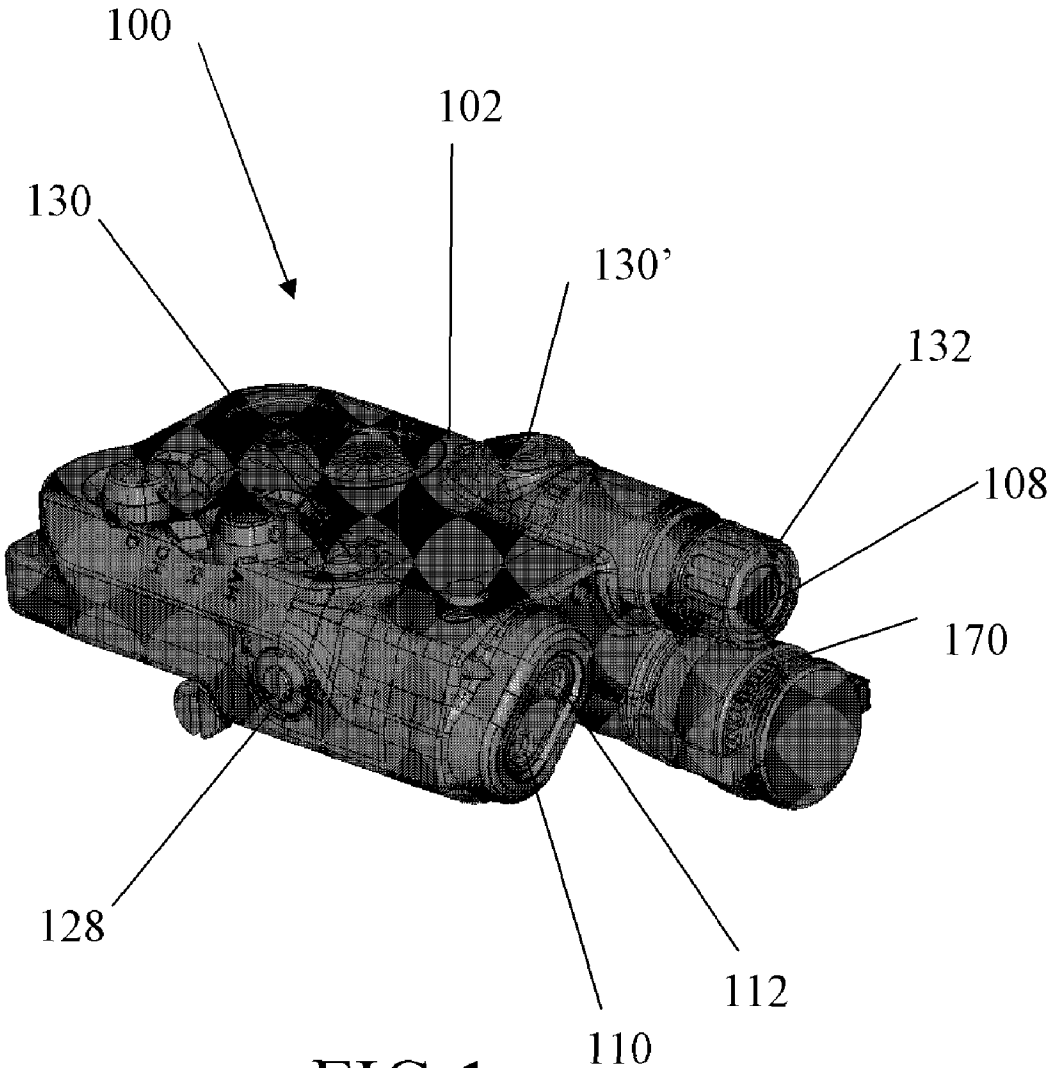
FIG. 1 is an isometric view of a weapon-mountable sight.
Figure 2B:
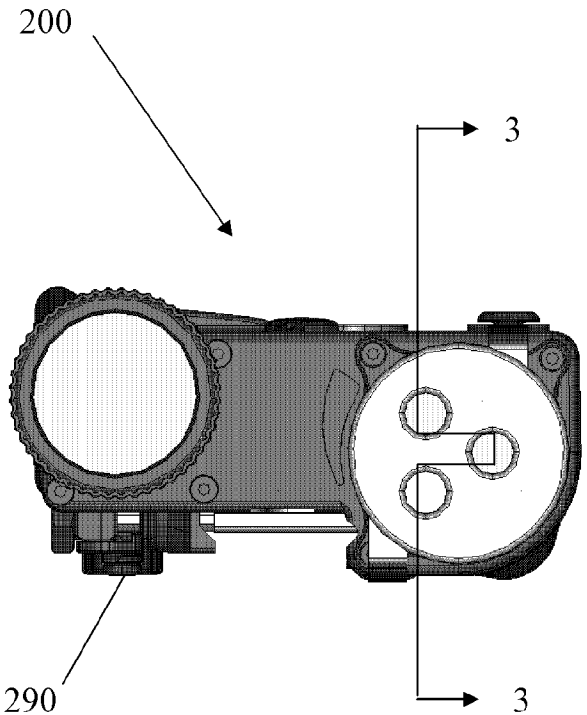
FIG. 2B is a front view of the weapon-mountable sight of FIG. 2A
Figure 2A:
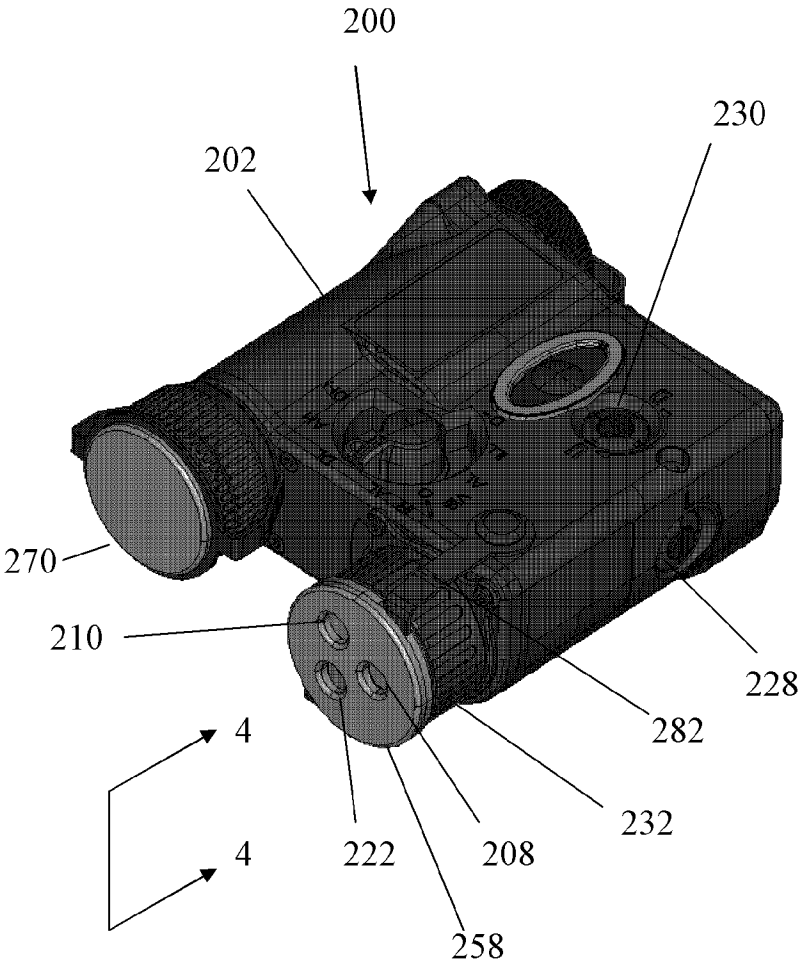
FIG. 2A is an isometric view of a weapon-mountable sight consistent with one embodiment of the invention.

FIG. 2A is an isometric view and FIG. 2B is a front view of a weapon-mountable sight 200 consistent with one embodiment of the invention. The optics and electronics may be at least partially enclosed in a housing 202 that is configured to be coupled to a weapon. The sight 200 may have an infrared laser illuminator assembly 208, a visible laser pointer assembly 210, an infrared laser pointer assembly 222, and a white light assembly 270, controlled by one or more switch actuators. A laser assembly may have a laser diode coupled to and spaced from a collimating lens as discussed below. The laser pointer assemblies 210, 222 and the infrared illuminator assembly 208 may be bore sighted to a weapon (not shown) using up-down adjuster 230 and left-right adjuster 228. Alternatively, the laser pointer assemblies 210, 222 may be adjusted using up-down adjuster 230 and left-right adjuster 228, and the infrared illuminator assembly 208 may be fixed relative to the housing 202. The divergence of the resulting infrared illuminator beam 242 (see FIG. 3A) may be adjusted from a narrow beam to a wide beam by rotation of a beam adjuster 232 that encircles the laser pointer assemblies 210, 222 and the infrared illuminator assembly 208. Alternatively, the beam adjustor can be translated to adjust the divergence of the resulting infrared illuminator beam 242. The beam adjustor 232 may have an outside dimension sized to allow an operator to adjust the beam size, perhaps even wearing gloves. Locating two or more of the laser assemblies within the beam adjustor can save space. A removable cover 258 having one or more pattern generators and/or a diffuser may be coupled to the housing 202 with one or more straps 282.

The sight 200 may be secured to a weapon using a mechanism 290. The sight 200 may be mounted to a weapon using a variety of mounting mechanism, including those disclosed in more detail in U.S. Pat. No. 5,430,967, titled, Aiming Assistance Device for a Weapon, issued on Jul. 11, 1995; U.S. Pat. No. 6,574,901, titled, Auxiliary Device for a Weapon and Attachment Thereof, issued Jun. 10, 2003; and U.S. Pat. No. 6,705,038, titled, Mounting Assembly for a Weapon, issued on Mar. 16, 2004, all of which are incorporated herein by reference in their entirety. Additionally, the sight may utilize a mounting mechanism compatible with a mounting rail disclosed in military specifications (e.g., MIL-STD-1913), a "rail grabber" mounting mechanism, levers, screws, bolts, and/or the like.

Figure 3A:
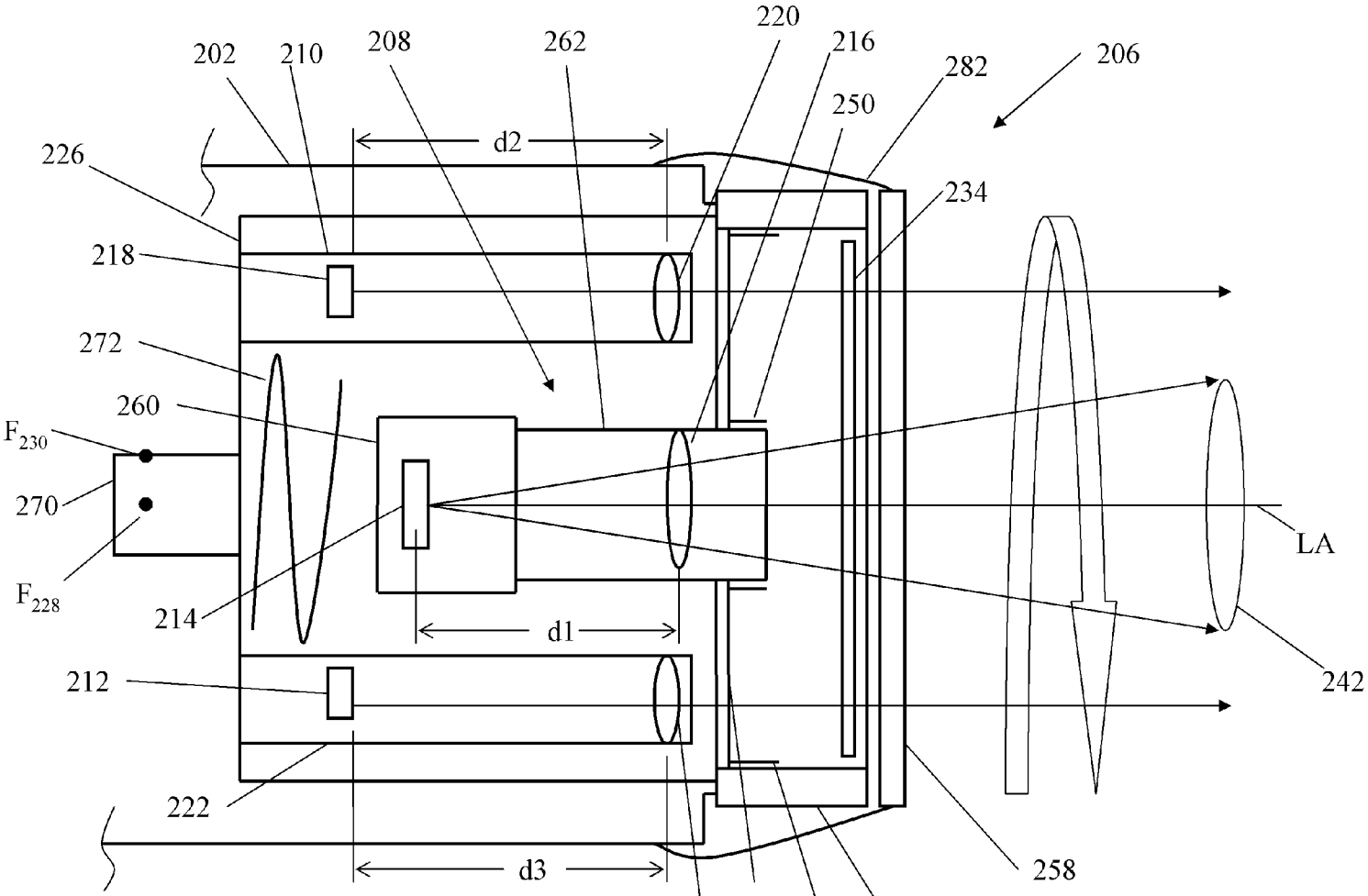
FIG. 3A is an illustration of a first tri-laser assembly consistent with one embodiment of the invention taken through line 3-3 of FIG. 2B.
Figure 3B:
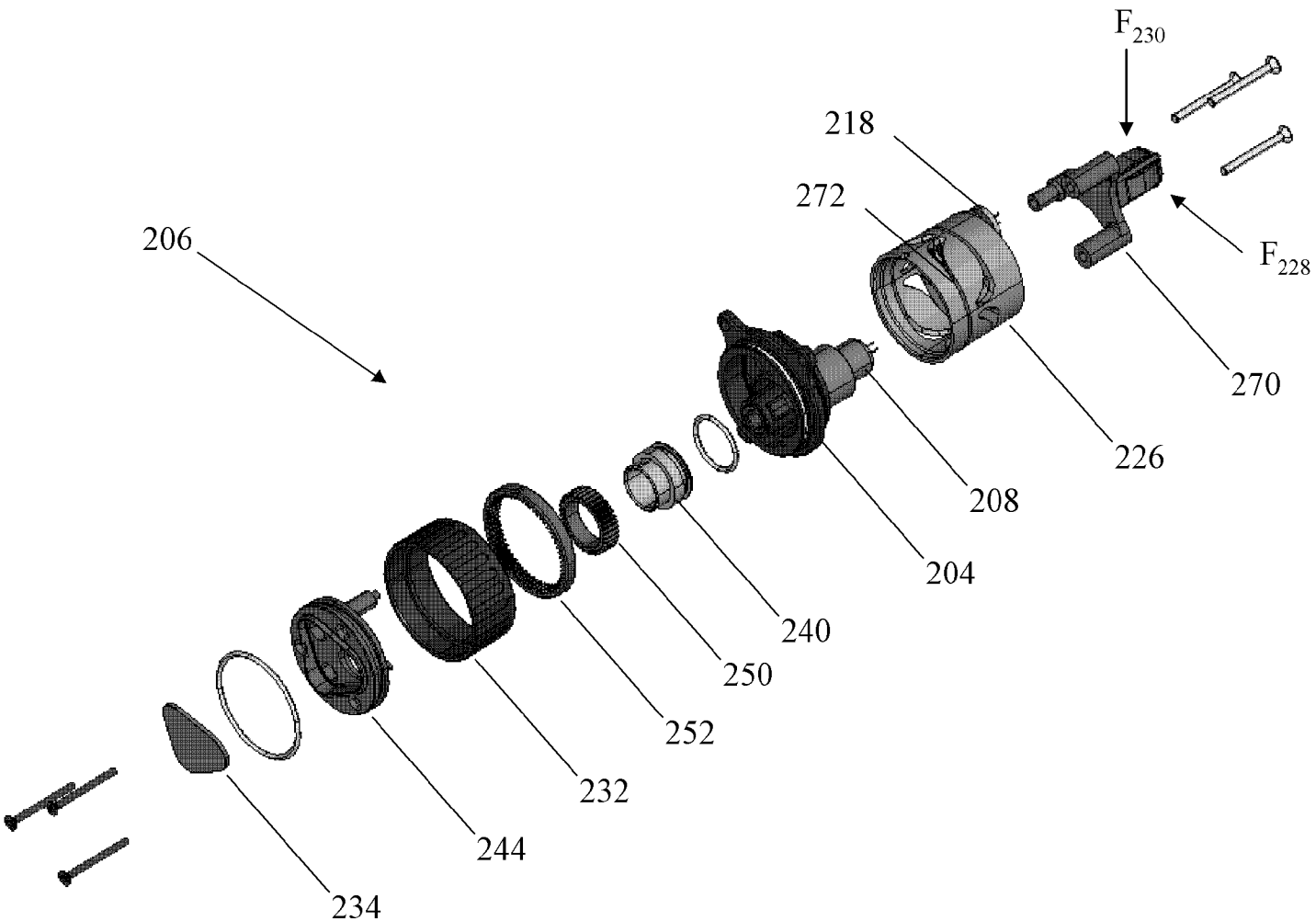
FIG. 3B is an exploded assembly view of the tri-laser assembly of FIG. 3A.
Figure 3E:
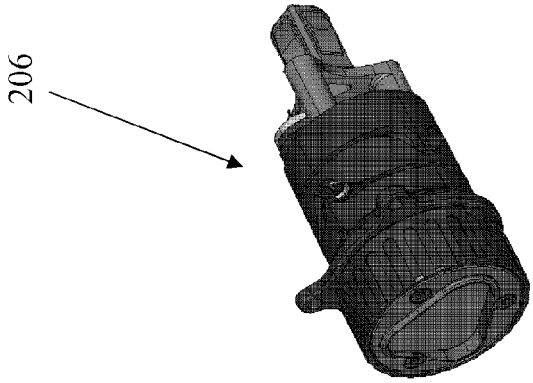
FIG. 3E is an isometric view of the tri-laser assembly of FIG. 3A.
Figure 3C:
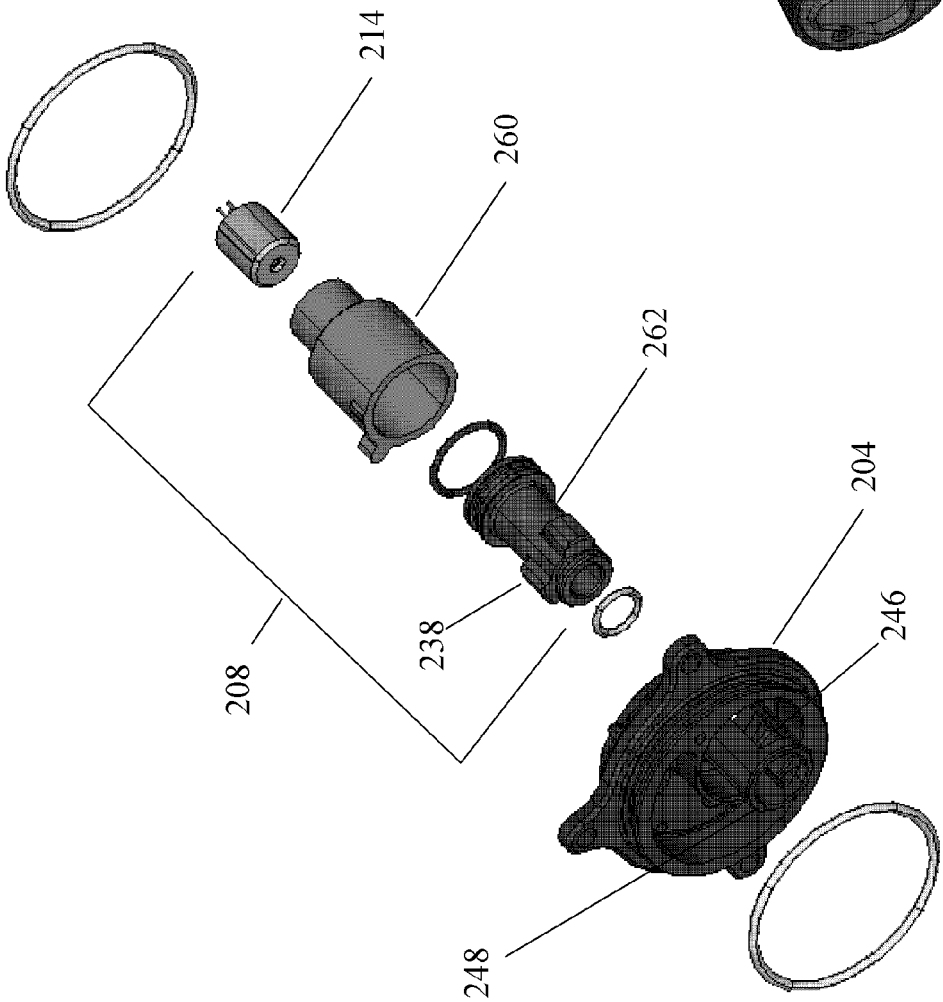
FIG. 3C is an exploded assembly view of a subassembly of the tri-laser assembly of FIG. 3B.
Figure 3D:
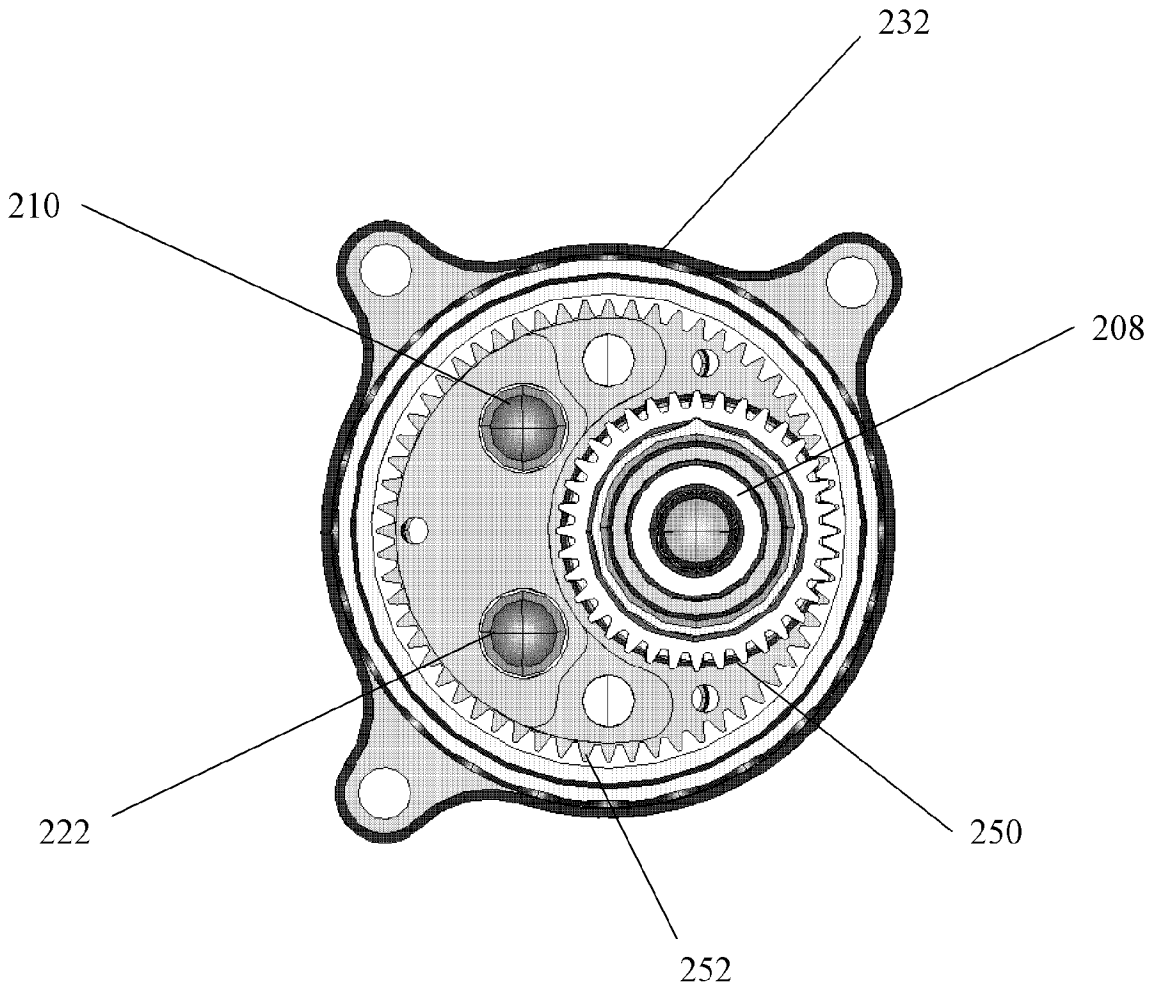
FIG. 3D is a front view of the tri-laser assembly of FIG. 3B.

FIG. 3A is an illustration, FIG. 3B and FIG. 3C are exploded assembly views, FIG. 3D is a front view, and FIG. 3E is an isometric view of a tri-laser assembly 206 consistent with one embodiment of the invention. The tri-laser assembly 206 may be incorporated in a weapon mountable sight 200. The tri-laser assembly 206 may have a window 234, a multi-laser cover 244, the beam adjuster 232, an illuminator drive ring 240, a front mount 204, a lens housing 262 having a lens 216, an illuminator housing 260, an optical bench 226, and a pivot adjuster 270. The window 234 may protect the lens of the infrared illuminator assembly 208 and the laser pointer assemblies 210, 222. The beam adjuster 232 may have a knurled outer surface to make grasping easier and a first gear 252 coupled to an inside surface thereof. First gear 252 may cooperate with a second gear 250 which may be coupled to an outer surface of the illuminator drive ring 240. The location of visible laser pointer assembly 210 and the infrared laser pointer assembly 222 may be swapped without departing from the invention.

The visible laser pointer assembly 210 may have a diode 218 spaced a fixed distance d2 from a lens 220 and the infrared laser pointer assembly 222 may have a diode 212 spaced a fixed distance d3 from a lens 224 so the exiting light is collimated. The visible laser pointer assembly 210 and the infrared laser pointer assembly 222 may be coupled to the optical bench 226 having a flexure 272. The flexure 272 may allow the laser pointer assemblies 210, 222 to be steered relative to the housing 202. The pivot adjuster 270 may be coupled to a rear surface of the optical bench 226 to allow for alignment of the laser pointer assemblies 210, 222 with a point of impact of a projectile of the weapon. Up-down adjuster 230 applies a force $F_{230}$ and left-right adjuster 228 applies a force $F_{228}$ to the pivot adjuster 270 to steer the laser pointer assemblies 210, 222. Springs or other biasing mechanisms may be used to provide a counter force to the adjustors 228, 230.

The Infrared illuminator assembly 208 may have a diode 214 coupled to the illuminator housing 260 and spaced an adjustable distance d1 from the lens 216. Diode 214 may be fixed inside a distal end of the illuminator housing 260 and the lens housing 262 may be slidably coupled inside a proximal end of the illuminator housing 260. The lens housing 262 may have one or more radially extending threaded sections 238. The illuminator housing 260 may be coupled to a rear surface of the front mount 204. Threaded sections 238 may extend through one or more longitudinal extending openings 246 in hollow cylinder 248 on the front mount 204 to prevent rotation of the lens 216 as the lens 216 is translated relative to the laser 214. Illuminator drive ring 240 may be sized to fit over cylinder 248 and have inwardly directed threads that cooperate with threaded sections 238 on the lens housing 262. When the beam adjuster 232 is rotated the illuminator drive ring 240 rotates causing lens housing 262 to slide longitudinally, which moves the lens 216 towards or away from the diode 214, thereby changing the resulting divergence of the infrared beam between a narrow pointer and a wide beam. Numerous screws and O-rings may be used to keep the assembly together and provide a sealed assembly. Although the assembly is described as a tri-laser assembly, a multi-laser assembly having two, or more than three lasers, should not be considered outside the scope of the invention.

Figure 4:
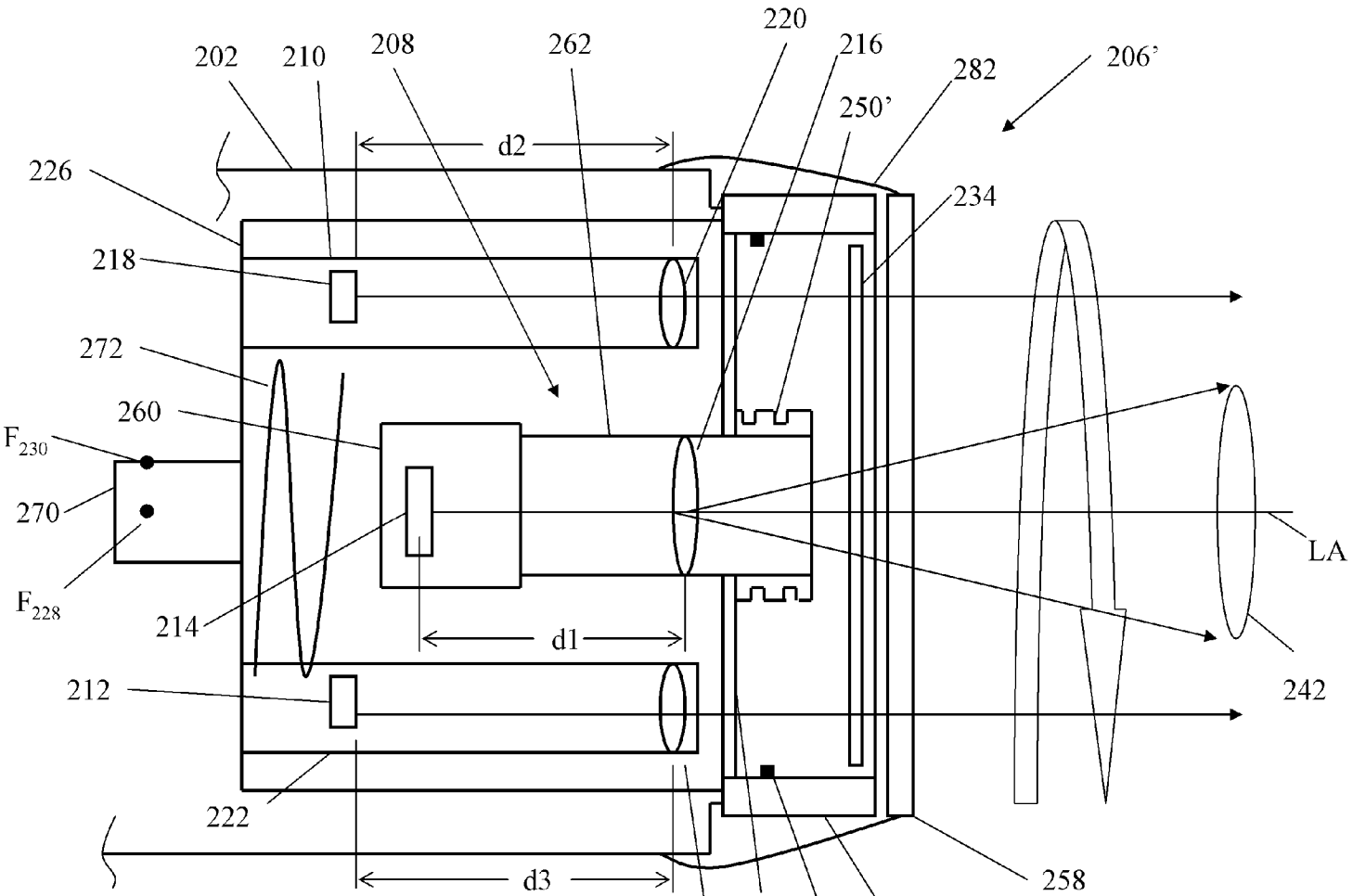
FIG. 4 is an illustration of a second tri-laser assembly consistent with one embodiment of the invention.

FIG. 4 is an illustration of a second tri-laser assembly 206' consistent with one embodiment of the invention. The tri-laser assembly 206' may be incorporated in a weapon mountable sight 200. A first feature, for example a protrusion 252', may be disposed on an inside surface of the beam adjuster 232' and cooperate with a second feature, for example a groove 250' disposed on an outside surface of the illuminator drive ring 240. The protrusion 252' and/or the groove 250' may have a pitch such that rotation of the beam adjuster 232' causes the lens 216 to travel along a longitudinal axis LA of the infrared illuminator beam 242 relative to the diode 214. The location of the groove and the protrusion may be changed without departing from the invention.

Figure 5A:
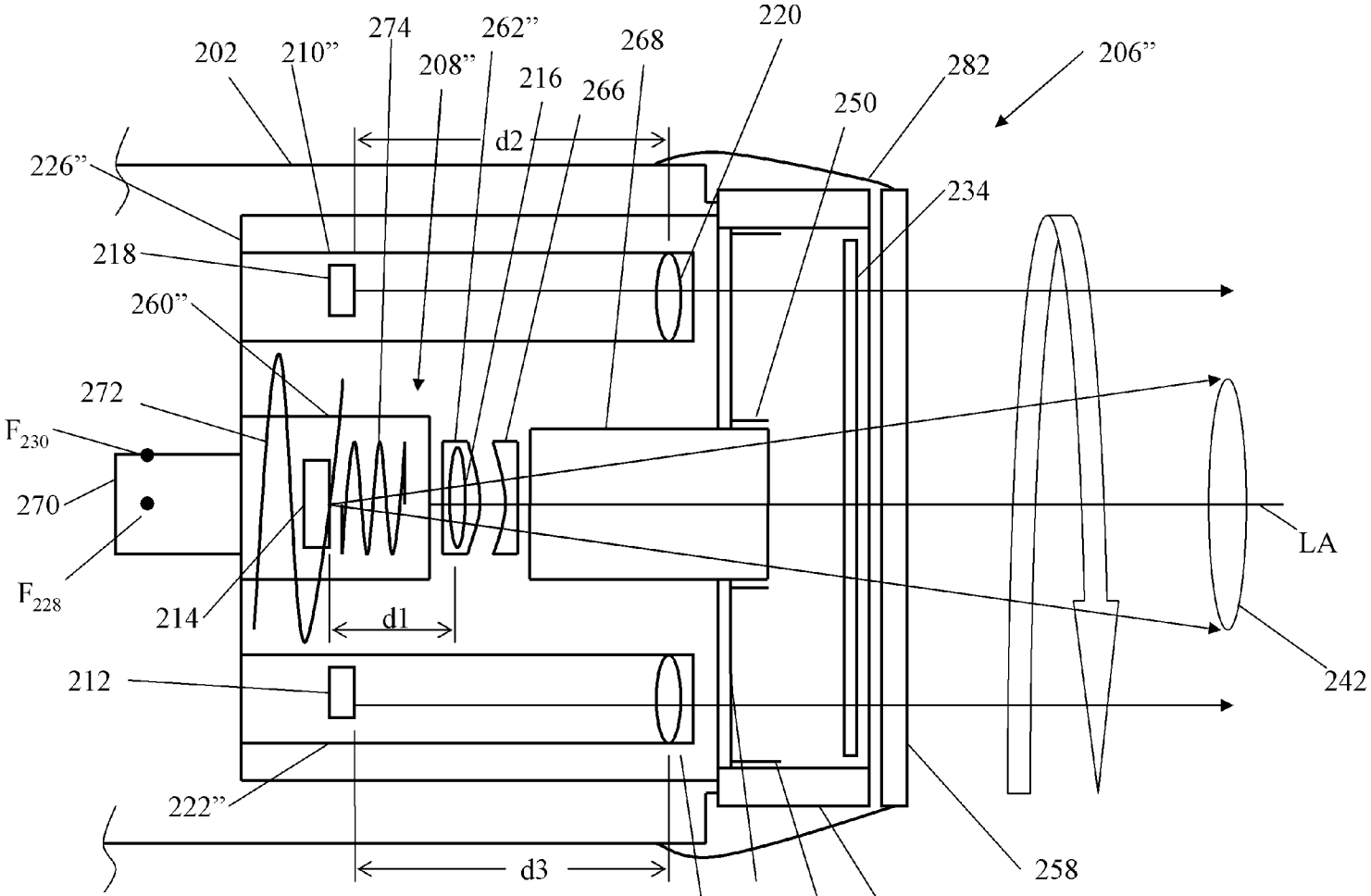
FIG. 5A is an illustration of a third tri-laser assembly consistent with one embodiment of the invention.
Figure 5B:
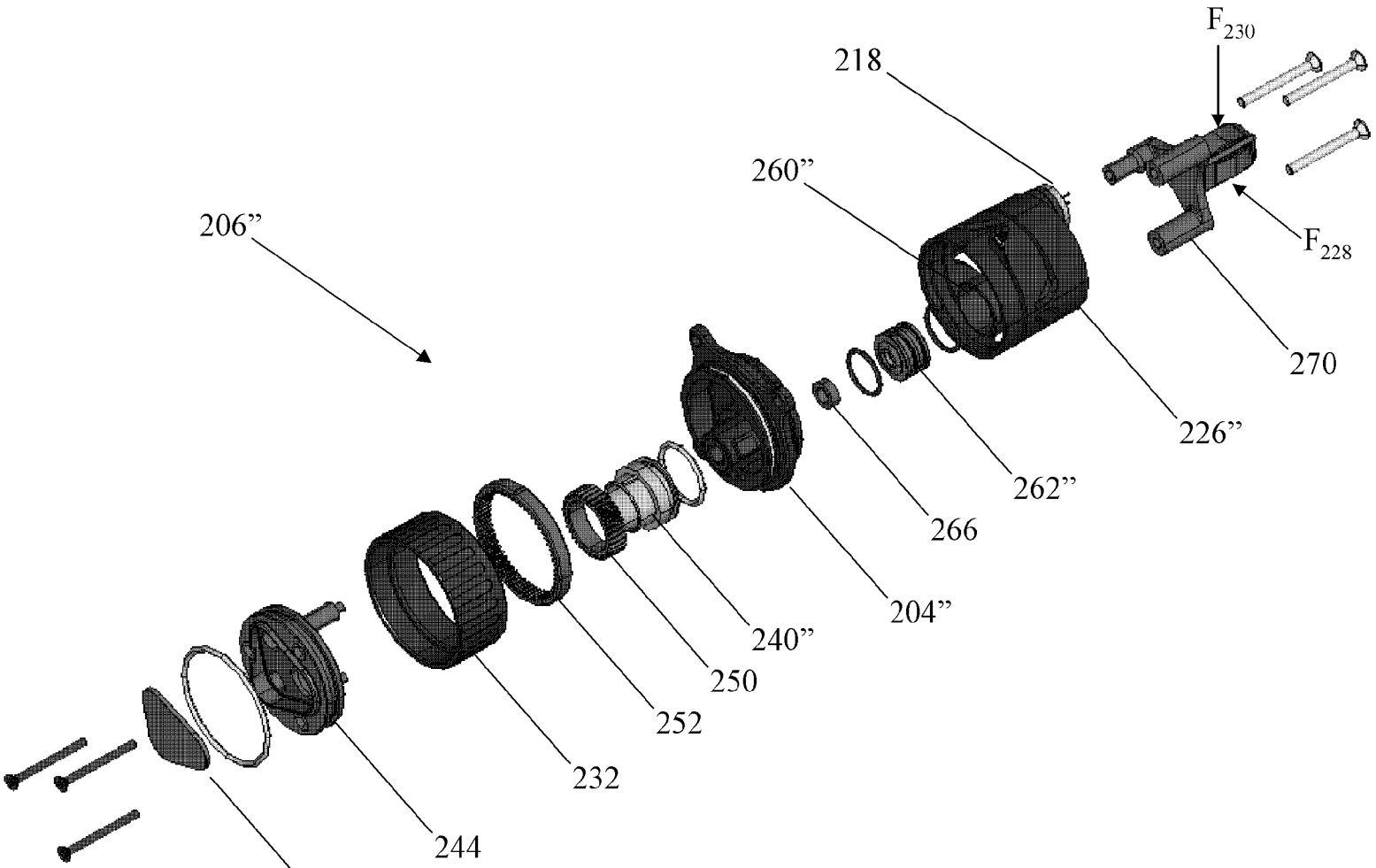
FIG. 5B is an exploded assembly view of the tri-laser assembly of FIG. 5A.
Figure 5C:
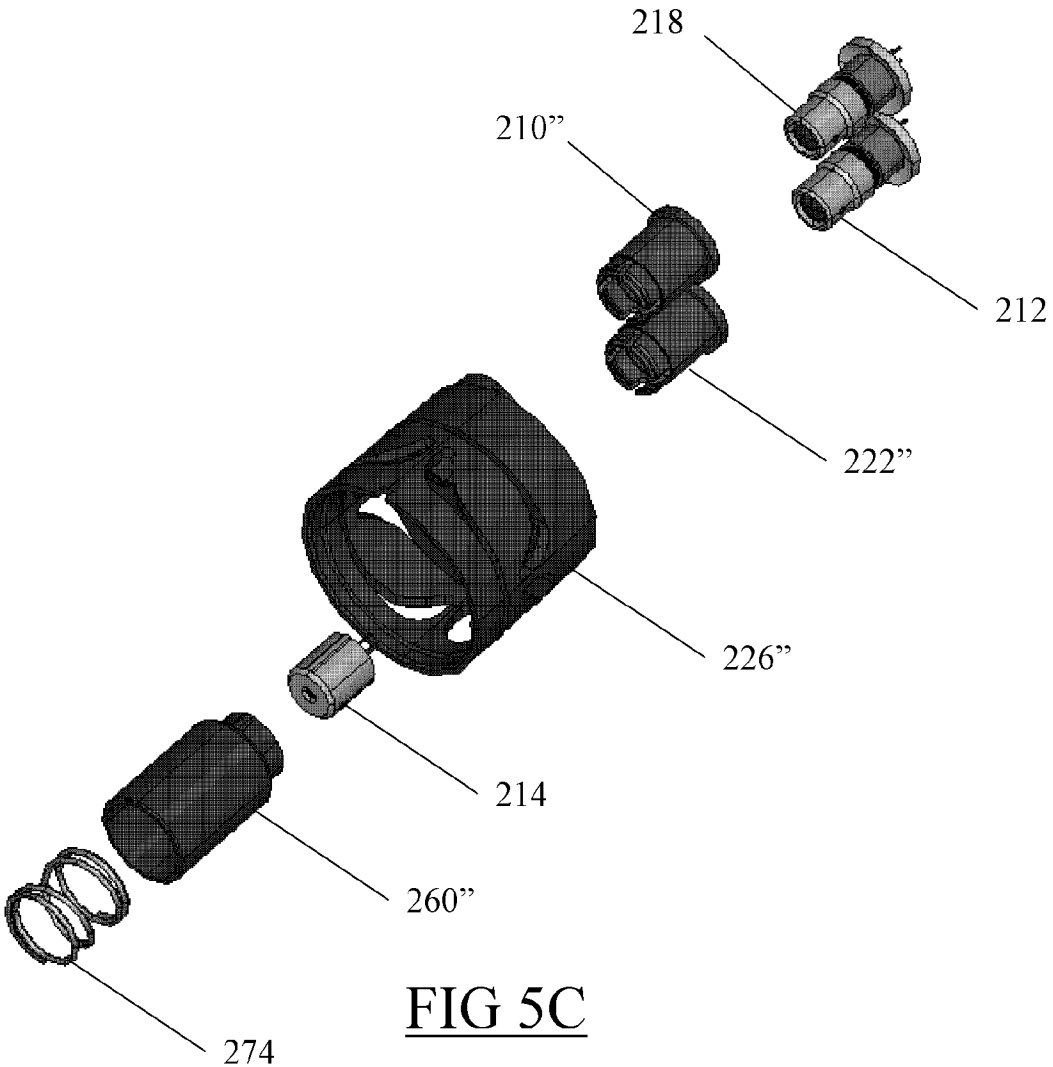
FIG. 5C is an exploded assembly view of a subassembly of the tri-laser assembly of FIG. 5B.
Figure 5D:
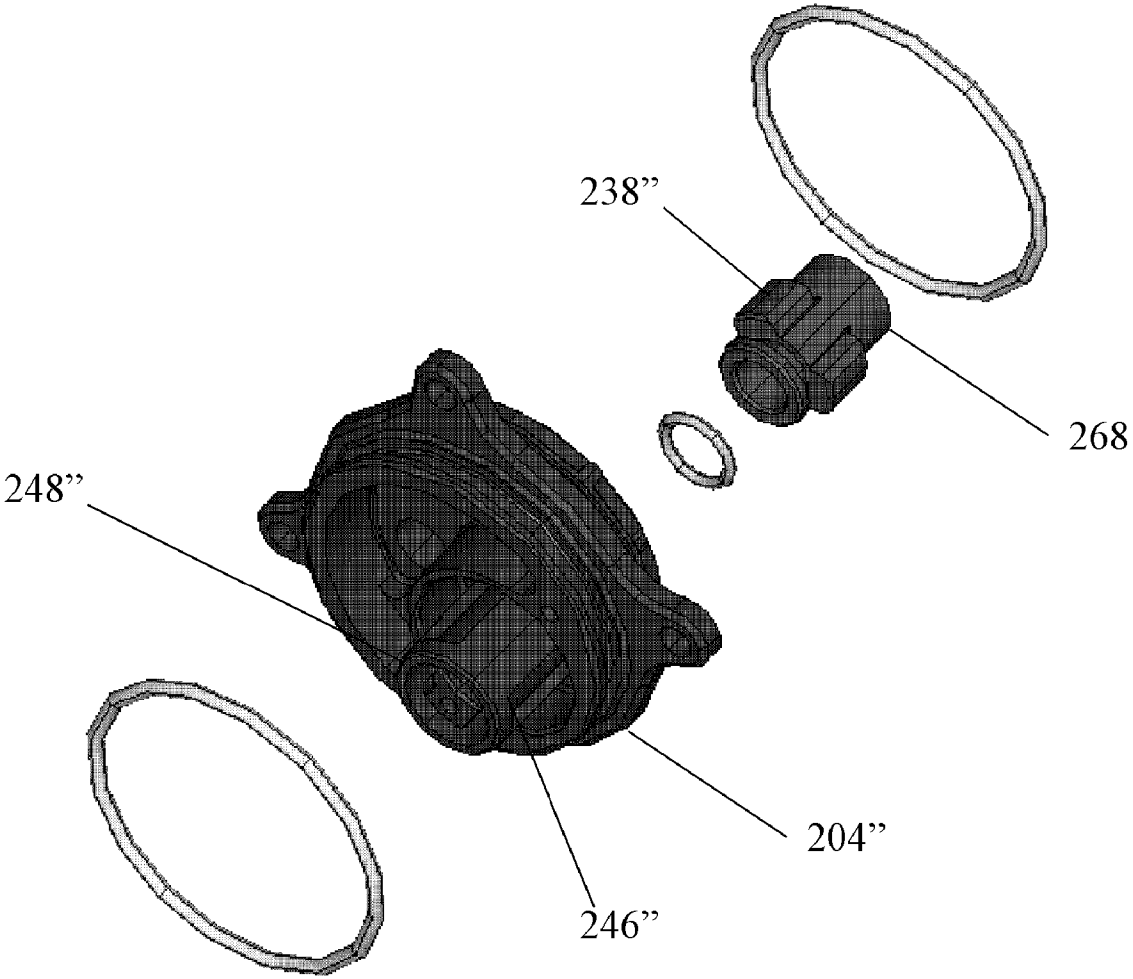
FIG. 5D is an exploded assembly view of a subassembly of the tri-laser assembly of FIG. 5B.

FIG. 5A is an illustration, FIG. 5B is an exploded assembly view, FIG. 5C is an exploded assembly view of a first subassembly, and FIG. 5D is an exploded assembly view of a second subassembly, of a third tri-laser assembly 206" consistent with one embodiment of the invention. The tri-laser assembly 206" may be incorporated in a weapon mountable sight 200. An infrared illuminator assembly 208" may have a piston 268 having one or more radially extending threaded sections 238". The threaded section(s) 238 may extend through one or more longitudinal extending openings 246" in a hollow cylinder 248" on a front mount 204". Illuminator drive ring 240" may be sized to fit over cylinder 248" and have inwardly directed threads that cooperate with threaded sections 238" on the piston 268. A pivot washer 266 may be slidably coupled within the piston 268 and have a flat front surface and an arcuate rear surface. The arcuate rear surface may cooperate with an arcuate front surface of a pivot lens housing 262" having a lens 216 therein. A spring 274 within an illuminator housing 260" coupled to the optical bench 226" may bias the lens housing 262" forward. Rotation of the beam adjuster 232" may cause the lens 216 to move toward or away from the diode 214.

The infrared illuminator assembly 208", the visible laser pointer assembly 210" and the infrared laser pointer assembly 222" may be coupled to the optical bench 226". The pivot adjuster 270 may be coupled to the rear surface of the optical bench 226" to allow for alignment of the laser pointer assemblies 210, 222 and the infrared illuminator assembly 208 with a point of impact of a projectile of the weapon. Up-down adjuster 230 applies a force $F_{230}$ and left-right adjuster 228 applies a force $F_{228}$ to the pivot adjuster 270.

A drive mechanism like the one shown in FIG. 3A and FIG. 4 may be used with the tri-laser assembly 206" as shown in FIG. 5A without departing from the present invention.

According to one aspect, the present disclosure may provide a weapon mountable sight including a housing configured to be coupled to a weapon and an optical bench within the housing that supports a visible laser pointer assembly, an infrared laser pointer assembly, and an infrared laser illuminator assembly.

According to another aspect, the present disclosure may provide a weapon mountable sight including a housing configured to be coupled to a weapon. Enclosed within the housing is a multi-laser assembly having a rotatable actuator configured to control the beam divergence of at least one of the lasers. The rotatable actuator having an opening extending therethrough to allow light from the lasers to extend therethrough.

According to another aspect, the present disclosure may provide a tri-laser assembly having a visible laser pointer assembly, an infrared laser pointer assembly, and an infrared laser illuminator assembly encircled by a rotatable actuator configured to control the beam width of at least one of the lasers.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

What is claimed:

1. A multi-laser assembly, comprising:

a visible laser pointer assembly comprising a first diode and a first collimating lens for collimating light emitted from said first diode, an infrared laser pointer assembly comprising a second diode and a second collimating lens for collimating light emitted from said second diode, and an infrared laser illuminator assembly all being encircled by an adjuster such that each is configured to emit a separate associated output through said adjuster, said adjuster being configured to allow beam divergence of at least one of the laser assemblies to be manually adjusted through movement of the adjuster.

2. The multi-laser assembly of claim 1, wherein the adjuster is rotatable and has an opening extending therethrough to allow light from the laser assemblies to extend therethrough.

3. The multi-laser assembly of claim 1, further comprising one of a thread and a cooperating groove disposed on an inside surface of the actuator, the actuator cooperating with the other of the thread and the groove disposed on an outside surface of the infrared laser illuminator assembly.

4. The multi-laser assembly of claim 1, wherein the first diode of the visible laser pointer assembly is spaced a fixed distance from the first collimating lens, the second diode of the infrared laser pointer assembly is spaced a fixed distance from the second collimating lens, and the infrared laser illuminator assembly is configured to allow a third diode to be spaced an adjustable distance from a third lens.

5. The multi-laser assembly of claim 4, wherein the adjuster is rotatable and rotation of the adjuster causes the third lens to travel along a longitudinal axis of the infrared laser illuminator assembly relative to the third diode.

6. The multi-laser assembly of claim 1, further comprising a plurality of gear teeth coupled to an inside surface of the adjuster, the adjuster cooperating with a plurality of gear teeth coupled to an outside surface of the infrared laser illuminator assembly.

7. The multi-laser assembly of claim 1, further comprising a pivot adjuster coupleable to an up-down adjuster and a left-right adjuster for steering a longitudinal axis of at least one of the laser assemblies.

8. The multi-laser assembly of claim 1, wherein the infrared laser illuminator assembly has a third laser diode coupled to and spaced from a third collimating lens.

9. The multi-laser assembly of claim 1, wherein the visible laser has a wavelength between 400 and 750 nm and the infrared laser has a wavelength greater than 750 nm.

10. The multi-laser assembly of claim 1, further comprising a pivot adjuster coupleable to an up-down and a left-right adjuster for steering the visible laser point assembly and the infrared laser pointer assembly as a group.

11. The multi-laser assembly of claim 1, further comprising a window spaced a fixed distance from the first collimating lens wherein each of the separate outputs exits through the window.

* * * * *